US006007439A

United States Patent [19]

MacKay, Jr.

[11] Patent Number: 6,007,439

[45] Date of Patent: Dec. 28, 1999

[54] VIBRATION DAMPENER FOR METAL BALL BATS AND SIMILAR IMPACT IMPLEMENTS

[75] Inventor: Jack W. MacKay, Jr., Mt. Pleasant, Tex.

[73] Assignee: Hillerich & Bradsby Co., Louisville, Ky.

[21] Appl. No.: 08/838,739

[22] Filed: Apr. 14, 1997

[51] Int. Cl.[6] ..... A63B 59/06

[52] U.S. Cl. ..... 473/520; 473/566

[58] Field of Search ..... 473/FOR 169, 473/318, 566, 332, 520, 568; 273/378

[56] References Cited

U.S. PATENT DOCUMENTS

| | | | |
|---|---|---|---|
| 3,811,596 | 5/1974 | Wilson | 220/24 A |
| 3,941,380 | 3/1976 | Lacoste | 273/72 A |
| 4,177,989 | 12/1979 | Easton et al. | 473/566 |
| 5,180,163 | 1/1993 | Lanctot et al. | 273/72 R |
| 5,183,264 | 2/1993 | Lanctot | 273/67 A |
| 5,203,561 | 4/1993 | Lanctot | 273/81 R |
| 5,219,164 | 6/1993 | Peng | 273/72 R |
| 5,362,046 | 11/1994 | Sims | 273/73 R |
| 5,380,003 | 1/1995 | Lanctot | 273/72 R |

FOREIGN PATENT DOCUMENTS

| | | |
|---|---|---|
| 52-037126 | 3/1977 | Japan . |
| 189442 | 8/1992 | Taiwan . |
| 195820 | 12/1992 | Taiwan . |

*Primary Examiner*—Mark S. Graham

*Attorney, Agent, or Firm*—Middleton & Reutlinger; Charles G. Lamb

[57] ABSTRACT

Dampening of vibrations transmitted to the handle of a tubular metal ball bat or similar implement when the ball bat impacts with a ball or when a similar implement imparts or receives an impact force in spaced relation to a handle normally grasped by a user of the implement. Vibration dampening reduces the "sting" normally transmitted to the hand or hands of the user thereby enabling the user to be more proficient when wielding the bat or other implement. One disclosed vibration dampener embodiment comprises a body of resilient foam-like material having a cylindrical plug which extends into the proximal end of the bat handle and a peripheral flange extending outwardly into the hollow interior of the knob. An axial extension engages the interior surface of the proximal end of the knob, leaving the peripheral flange to oscillate or flex to absorb vibration imparted to the handle of the metal bat. A second disclosed vibration dampener comprises a cylindrical pressurized bladder extending substantially throughout the length of the bat handle, with the inflated bladder exerting an outward pressurized force against the interior surface of the handle. The pressurized bladder supports the tubular handle of the bat and reduces the vibrations that may be transmitted to the handle. The two embodiments can be used singly or in combination to attenuate vibrations imparted to the bat or other implement handle.

19 Claims, 3 Drawing Sheets

VIBRATION DAMPENER FOR METAL BALL BATS AND SIMILAR IMPACT IMPLEMENTS

BACKGROUND OF THE INVENTION

1. Field of the Invention

This invention relates to the dampening of vibrations transmitted to the handle of a tubular metal ball bat or similar implement when the ball bat impacts with a ball or when a similar implement imparts or receives an impact force in spaced relation to a handle normally grasped by a user of the implement. Vibration dampening reduces the "sting" normally transmitted to the hand or hands of the user thereby enabling the user to be more proficient when wielding the bat or other implement.

2. Description of the Prior Art

Metal ball bats and similar implements which impart impact forces or receive impact forces transmit vibrations of various amplitudes and frequencies to the gripping handle of the bat or other implement resulting in the hand or hands of the user being "stung" and possibly injured by the vibrations transmitted to the handle.

Various efforts have been made to reduce the transmission of vibrations to the handle of a metal ball bat or other implement such as forming a transverse wall in the transition area between a hitting zone and a handle of a bat as disclosed in copending application Ser. No. 08/791,464, filed Jan. 27, 1997, pading, and by providing an inflated bladder or bladders in the hitting zone of a bat which may also include a transverse wall at the proximal end of the hitting zone as disclosed in copending application Ser. No. 08/802,516, filed Feb. 20, 1997 pading, Also, U.S. Pat. No. 5,362,046, issued Nov. 8, 1994, discloses a vibration dampener in the form of a body of resilient material mounted at the proximal end of the handle and knob of the bat. The dampener is placed in the hollow handle and knob through an opening in the knob after the knob has been welded or otherwise joined to the handle, and a closure cap then is assembled on the proximal end of the knob to form the closure for the opening in the knob.

U.S. Pat. No. 5,362,046 does not disclose a vibration dampener which is assembled prior to the knob being placed on and welded onto the tubular handle which enables the proximal end of the knob to be of unitary construction for the peripheral and distal end of the knob. Such unitary construction eliminates the necessity of using a closure cap on the knob which, in some instances, can become dislodged when the bat strikes a ball. The closure cap as shown in FIG. 4 also contacts the vibration dampener in areas disposed radially outwardly of the circumference of a cylindrical area corresponding to the circumference of the bat handle thereby reducing the vibration damping characteristics of the vibration dampener.

Accordingly, there is a need for vibration dampening elements in the handle portion of metal bats, such as baseball and softball bats, which provide a unitary construction for the welded on knob and otherwise provide improved dampening characteristics in the handle portion of bats and other implements which are subject to vibration when the hitting portion is impacted with another object.

SUMMARY OF THE INVENTION

One form of the vibration dampener of the present invention is a specially configured body of lightweight, soft, resilient foam-like material which is incorporated into the handle end and knob portion of a tubular metal ball bat, such as a baseball bat or softball bat, or similar impact implement, especially one having a metal handle. The dampener body includes a generally cylindrical plug which extends into and is anchored to the interior surface of the proximal end of the handle and projects axially therefrom. The dampener body also includes a peripheral flange extending outwardly into the hollow interior of the knob beyond the periphery of the tubular handle and in axially spaced relation to the end of the handle and the proximal end of the knob. The peripheral flange is configured so that its outer edges are spaced slightly away from the interior surfaces of the knob. This spacing is necessary in order to enable unrestricted flexible movement of that portion of the resilient dampener body comprising the flange. The vibration dampener also includes an axial extension which engages the interior surface of the proximal end of the knob. Preferably, the proximal end of the knob includes an axially offset portion which engages the proximal end of the axial extension to thus position the dampener in the handle end and knob. Also, preferably, the dampener includes a small central longitudinal passage therethrough which mates with an aperture in the approximate center of the proximal end of the knob.

In accordance with this first embodiment of the present invention, the entire knob of the bat is made of a unitary construction. The vibration dampener is assembled into the knob with the axial extension engaging the interior surface at the bottom of the knob. The knob is then assembled onto the proximal end of the tubular handle of the bat and welded in place. This assembly eliminates the necessity of providing a closure cap for an open proximal end of the knob as is previously known in the prior art.

A second alternative vibration dampening device in accordance with the present invention comprises a cylindrical pressurized bladder inflated with air or other inert gas which preferably extends substantially throughout the length of the handle of the bat, or other implement. The inflated bladder exerts an outward pressurized force against the interior surface of the handle substantially throughout its length and serves to reduce or attenuate vibrations that may have been transmitted to the handle from the hitting zone and transition zone. The inflated bladder also frictionally engages the inside surface of the bat handle thus serving to fix the bladder in place. The pressurized bladder also supports the peripheral wall defining the tubular handle of the bat thereby increasing its strength and enabling the handle to be constructed of thinner metal, if desired when the inflated bladder is used.

While the vibration dampener formed by the foam-like material and the vibration dampener formed by the pressurized bladder may be used separately as the only vibration dampening device in a tubular metal bat, or other implement handle subject to vibration, it is also contemplated within the present invention that these two forms of vibration dampening devices can be used together to augment each other in their vibration dampening characteristics. Thus, the vibration dampener comprising a resilient body inserted into the handle end and knob portion of the ball bat and the vibration dampener comprising the cylindrical pressurized bladder extending substantially through the bat handle can be used singly or in combination.

Accordingly, it is an object of the present invention to provide a hollow metal ball bat having a tubular barrel defining a hitting zone at the distal end, a transition zone at the proximal end of the hitting zone and a handle at the proximal end of the transition zone with the handle including a knob at the proximal end combined with a vibration dampener incorporated into the handle and/or knob to reduce or attenuate vibrations which have been transmitted to the handle from imparting such vibrations to the hands of a person gripping the handle.

Another object of the invention is to provide a vibration dampener for a tubular metal ball bat, or similar impact implement, in the form of a body of lightweight, foam-like, resilient material having a stem inserted into and anchored in the proximal end of the tubular handle and provided with a peripheral flange oriented within but in spaced relation to the interior of the knob on the bat handle in which the vibration dampener is assembled into the knob and the knob then assembled onto the proximal end of the bat handle and welded, or otherwise permanently secured in place, thereby eliminating the necessity of providing a separate closure cap for the open proximal end of the knob such as when the vibration dampener is assembled into the knob and handle through an opening in the knob after the knob has been affixed to the handle.

A further object of the invention is to provide a vibration dampener in accordance with the preceding objects in which the flexible resilient flange is spaced from the proximal end of the knob by an axial projection engaging the inner surface of the proximal end of the knob in an area substantially less than the surface area of the flange which projects radially into the knob.

Still another object of the invention is to provide a vibration dampener in accordance with the preceding objects in which the foam-like resilient material includes a central longitudinal passage therethrough.

A still further object of the invention is to provide a vibration dampener in accordance with the preceding objects in which the proximal end of the knob includes an axially offset portion engaged by the axial projection at the center of the flexible resilient flange with the center of the proximal end of the knob including an aperture in alignment with the passage through the vibration dampener.

Yet another object of the present invention is to provide a vibration dampener in the form of a pressurized bladder of generally cylindrical configuration extending substantially throughout the length of a tubular metal handle and frictionally engaging the interior surface of the handle for anchoring the bladder in position and reducing or attenuating vibrations transmitted to the handle from the remainder of a ball bat or implement.

Another object of the present invention is to provide a vibration dampener in accordance with the preceding object in which the inflated bladder supports the peripheral wall defining the tubular handle to stabilize the peripheral wall, reduce vibrations passing along the wall and enable the peripheral wall of the handle to be of reduced thickness.

A still further significant object of the invention is to provide a metal ball bat having a tubular barrel including a hitting zone, transition zone, handle and knob combined with a vibration dampener in the form of an inflated bladder positioned interiorly of the handle and extending substantially throughout the length thereof with the bladder being of cylindrical configuration and frictionally and supportingly engaging the interior surface of the tubular handle thereby reducing or attenuating vibration forces transmitted by the handle to the hand or hands of a user of the bat.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
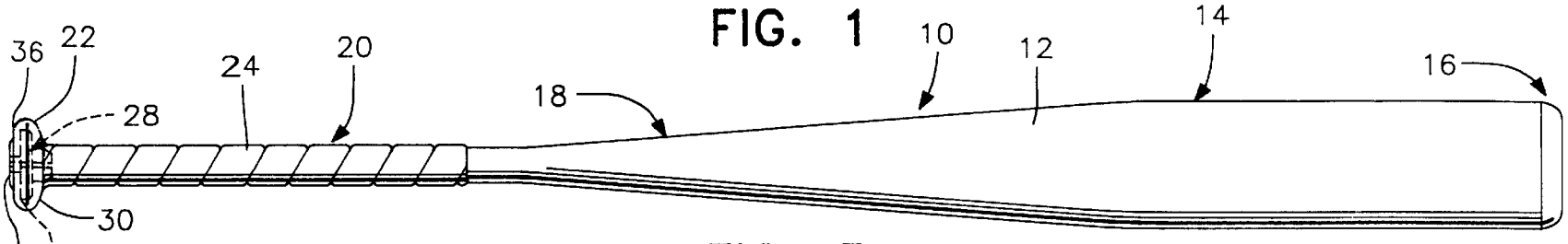
FIG. 1 is a side elevational view of a hollow metal bat illustrating one embodiment of the vibration dampener of the present invention incorporated into the tubular handle and knob.

In describing the preferred embodiments of the present invention as illustrated in the drawings, specific terminology will be resorted to for the sake of clarity. However, the invention is not intended to be limited to the specific embodiment illustrated and terms so selected; it being understood that each specific term includes all technical equivalents which operate in a similar manner to accomplish a similar purpose.

Figure 2:
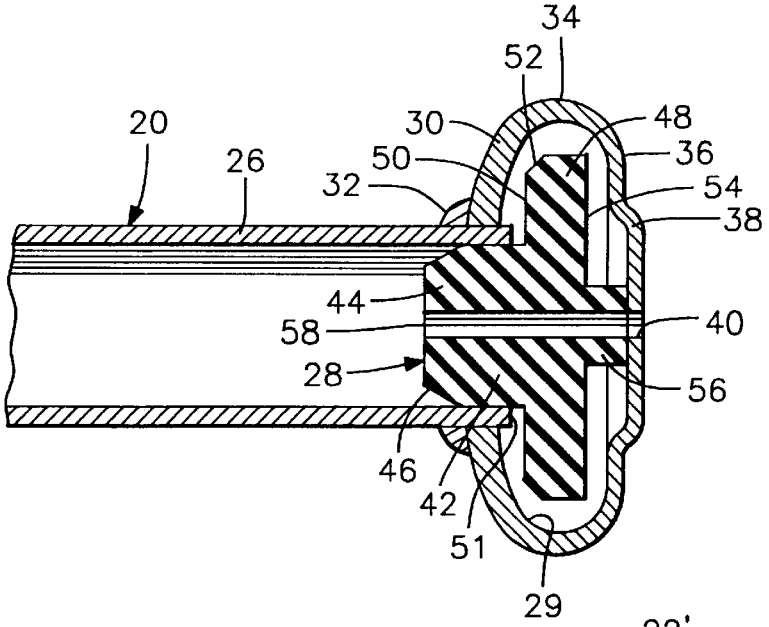
FIG. 2 is an enlarged sectional view of the knob end of the handle illustrating the vibration dampener of FIG. 1 positioned in the knob end.
Figure 3:
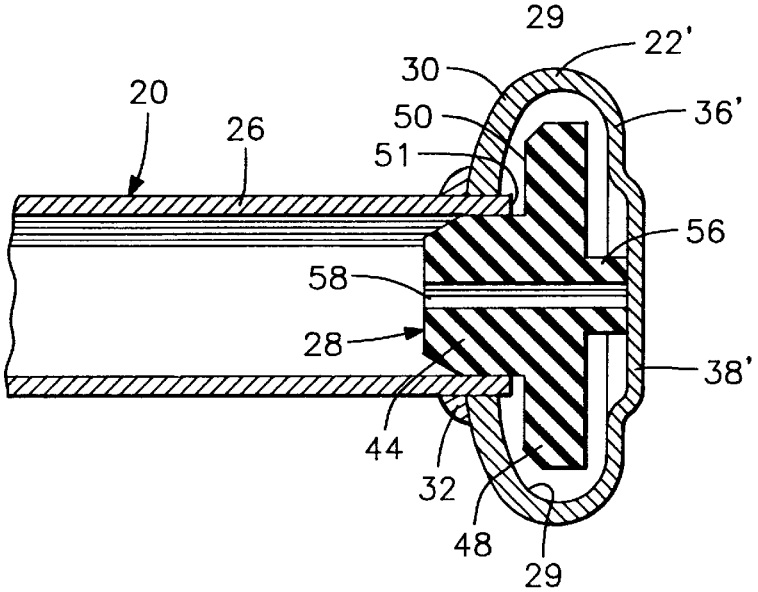
FIG. 3 is a sectional view similar to FIG. 2 but illustrating an arrangement in which the proximal end of the knob is imperforate.

Referring to the embodiment of the invention illustrated in FIGS. 1–3 of the drawings, the hollow metal bat, such as a baseball bat or softball bat, is generally designated by reference numeral 10 and includes a hollow barrel 12 extending throughout the length thereof. The barrel 12 includes a hitting zone 14 at the distal end which is provided with an end cap 16 forming a closure for the distal end. The bat barrel 12 also includes a tapered transition zone 18 extending from the proximal end of the hitting zone 14 to a tubular handle generally designated by reference numeral 20. The handle 20 includes a closure knob 22 permanently secured at the proximal end thereof and grip enhancing material 24 extending substantially along the entire length of the handle in a known manner to facilitate gripping of the bat by a person utilizing the bat to swing in a manner to strike a baseball, soft ball or the like.

The handle 20 is formed by a generally cylindrical peripheral wall 26 which preferably has substantially the same thickness and diameter throughout the length thereof.

A vibration dampener 28 is positioned within the knob 22 and the proximal end of the handle 20 as illustrated in FIG. 2. The knob 22 has a hollow interior 29 and includes a curved distal wall 30 secured to the proximal end of the handle 20 as by welding 32 or the like. The periphery of the knob 22 is reversely curved as indicated by reference numeral 34 and extends into a generally flat, circular end wall 36 perpendicular to the longitudinal axis of the handle 20. The end wall 26 preferably includes an axially offset central portion 38 having a centrally located aperture 40 therein. The knob is made in a unitary construction of metal, preferably the same or similar metal as the hollow barrel 12, and is welded to the end of the bat handle 20 in a well known manner.

The vibration dampener 28 includes a body of resilient, foam-like material having a generally cylindrical stem 44 that telescopes into the proximal end of the peripheral wall 26 of the handle 20. The distal end of the stem 44 is bevelled at 46 to facilitate insertion of the stem 44 into the handle 20. The stem 44 thus forms a plug that closes the end of the handle 26 and is frictionally held in place therein. Alternatively, or in addition, a bonding agent can be utilized on the periphery of the stem 44 to anchor the vibration dampener 28 in place in the end of the handle. The body 42 also includes a cylindrical flange 48 integral with the stem 44 which extends laterally outwardly and peripherally in the interior of the knob 22. However, the external periphery of the flange 48 is configured to be spaced away from the interior surface 30 of the knob 22 around its entire surface, such as illustrated in FIG. 3. In this manner, the flange 48 is free to oscillate up and down, or move in any direction in relation to the knob and the stem 44 of the body 42.

The distal surface 50 of the flange 48 is spaced from the end 51 of the peripheral wall 26 of the handle 20 so that the peripheral wall 26 does not impede or otherwise interfere with the oscillation or flexible movement of the flange 48. Also, the peripheral corner of the flange 48 which faces the curved interior surface 29 of the knob 22 is preferably chambered as at 52 to enable additional oscillation or flexible movement of the flange 48 within the knob 22. The flange 48 and the body 42 include a flat proximal surface 54 that is spaced from the interior surface of the end wall 36 and the offset portion 38 to enable unrestricted oscillation or flexing of the flange 48. The surface 54 of the body 42 includes a cylindrical axial projection 56 of substantially smaller diameter than the flange 48 and the stem 44. The proximal end of the projection 56 engages the interior surface of the offset portion 38 to stabilize the body 42 and retain the stem 44 in the end of the handle 26 during oscillation or flexing movement of the flange 48.

The body 42, including stem 44, flange 48 and projection 56, of the vibration dampener 28 includes a central passageway or bore 58 extending from the distal end of the stem 44 continuously through the proximal end of the projection 56. The passageway or bore 58 is preferably cylindrical and in alignment with the aperture 40 in the offset portion 38 of the end wall 36 of the knob 22 to communicate the interior of the handle with atmosphere. The bore 58 also weakens the interior of the body 42 including the stem 44 and the projection 56. This weakening enhances the flexibility of the flange 48 since its area of connection with the stem 44 and the projection 56 has been reduced by the cross-sectional area of the passageway or bore 58. The weakening of the stem 44 also assists in the insertion of the stem 44 into the handle end.

FIG. 3 illustrates a structure substantially identical to FIG. 2 except that the offset central portion 38' of the proximal end wall 36' of the knob 22' is imperforate and does not include any opening that communicates the interior of the bat handle with atmosphere.

The body 42 of dampener 28 is preferably of one-piece construction made of a resilient, foam-like material such as polyurethane, rubber or other polymer or elastomeric material. The material is selected so that the flange 48 will oscillate or flex up and down to absorb vibration imparted to the handle 26. The oscillating action of the flange 48 is described in U.S. Pat. No. 5,362,046 and the materials disclosed for the dampener therein are also suitable for the present invention.

Figure 4:
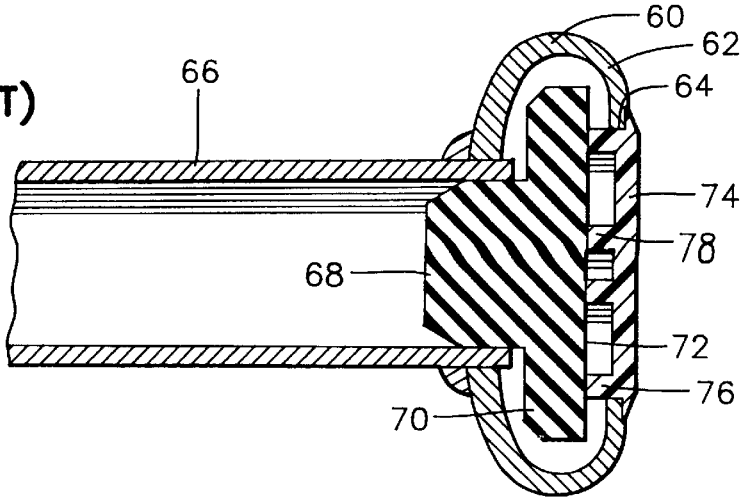
FIG. 4 (PRIOR ART)
FIG. 4 is a sectional view of a known vibration dampener in which the proximal end of the knob has an enlarged opening closed by a snap-in closure cap that engages the flexible flange over a major portion of the surface area.

In assembling the structure illustrated in FIGS. 2 and 3, the vibration dampener 28 is assembled into the knob 22 and the knob 22 is then positioned onto the handle 20 and welded in place as at 32. This construction provides a continuous peripheral wall enclosing the vibration dampener and, in particular, provides a solid proximal end wall on the knob 22. The prior art as illustrated in FIG. 4 includes a knob 60 having a proximal end wall 62 provided with an opening 64 therein which is larger in diameter than the peripheral wall of the handle 66. Also, the vibration dampener body 68 of resilient foam-like material is solid and includes an outwardly projecting flange 70 having a substantially flat proximal surface 72 spaced from the end wall 62. The opening 64 in the end wall 62 is closed by a circular closure member or cap 74. The cap 74 has inwardly extending flanges 76 and 78 of circular configuration which engage the flat proximal surface 72 of the flange 70 adjacent the center thereof and also in a peripheral area outwardly of the periphery of the tubular handle 66. These flanges, especially flange 76, limit the degree of oscillation or flexible movement capable of being obtained by the periphery of the flange 70. Also, even though the closure plug 74 is frictionally held in place and can also be glued in place, the plug often becomes dislodged upon the bat striking a ball and pops out of the opening 64, thus destroying the integrity of the bat. Further, dislodgement of the plug 74 causes a malfunction of the vibration dampener 68.

Figure 5:
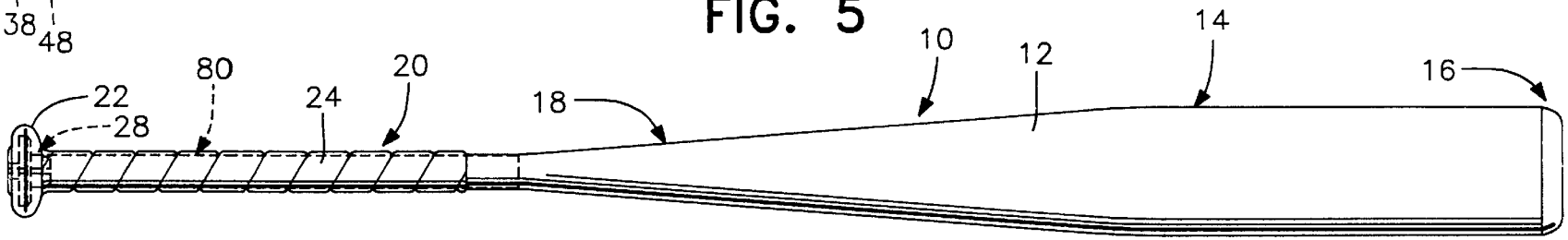
FIG. 5 is a side elevational view of the bat illustrating a second embodiment of the vibration dampener of the present invention in the form of an inflated bladder in the handle together with the vibration dampener illustrated in FIG. 1.
Figure 6:
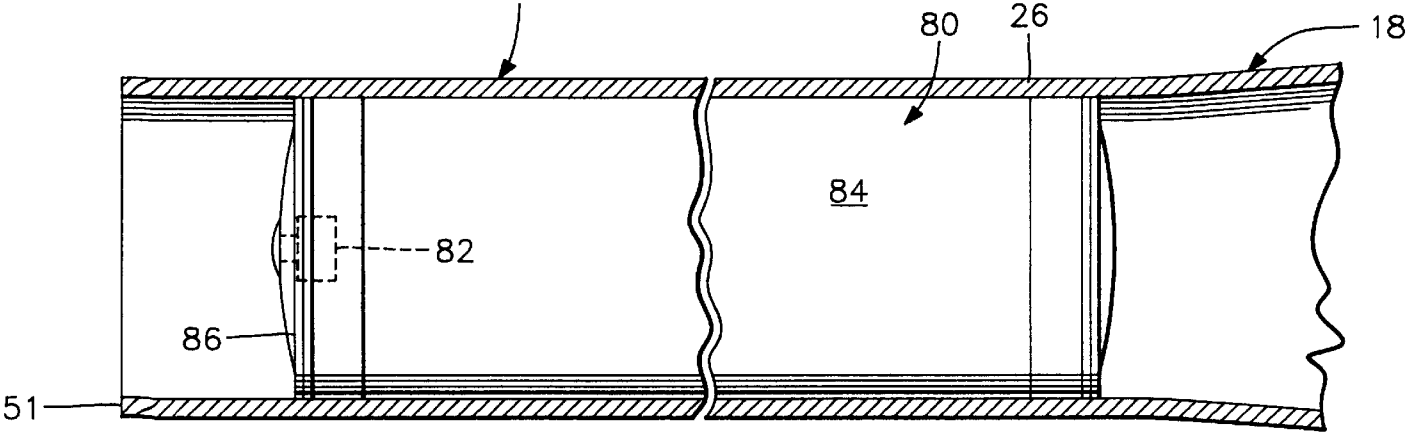
FIG. 6 is a longitudinal sectional view on an enlarged scale illustrating the inflated bladder dampener of the present invention extending substantially throughout the length of the tubular handle.

Turning to the second embodiment of the present invention, FIG. 5 discloses bat 10, hollow barrel 12, hitting zone 14, end cap 16, transition zone 18, handle 20, knob 22 and handle wrapping 24 which are the same as in FIG. 1. Also, the knob 22 and adjacent portion of the handle is also identical to that shown in FIG. 1. In this embodiment of the invention, a pressurized bladder generally designated by reference numeral 80 is positioned in the handle 20 interiorly of the peripheral wall 26 as illustrated in FIG. 6. The bladder 80 is of flexible, resilient material preferably having a generally cylindrical side wall 84. It further preferably extends substantially throughout the length of the handle 20, but shorter lengths are acceptable. An inflation valve 82 is preferably installed in the proximal end wall 86 of the bladder 80 which is capable of receiving an inflation needle to inflate the cylindrical bladder 80 to a predetermined pressure. Inflation of the bladder 80 causes the periphery of the bladder 80 to frictionally engage the interior surface of the wall 26 to anchor the bladder in position and also support and stabilize the wall 26 to enable a thinner wall, or grooved wall, to be used in the handle. The specific structural details of the bladder, except for the dimensions thereof, is the same as any one of the bladder arrangements disclosed in copending application U.S. Ser. No. 08/802,516, filed Feb. 20, 1997, the entire disclosure of which is incorporated herein by reference.

Figure 7:
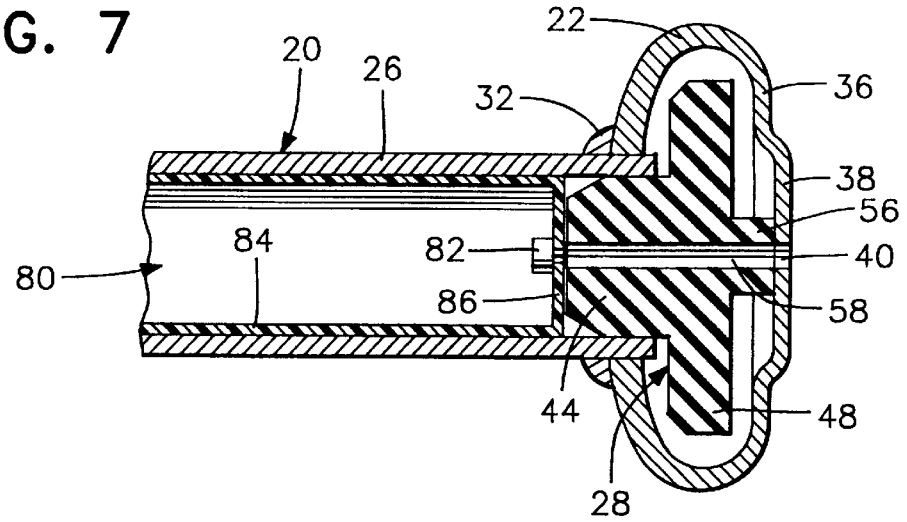
FIG. 7 is a sectional view, on an enlarged scale, illustrating the combination of the pressurized bladder and vibration dampener illustrated in FIG. 2 to augment the vibration dampener characteristics to reduce vibrations transmitted to the handle.

As illustrated in FIG. 7, the structure of the dampener 28 and its relationship to the knob 22 is the same as that in FIG.

2. The bladder 80 includes a peripheral wall 84 of cylindrical configuration with the valve 82 being positioned in the proximal end wall 86 in alignment with the passageway 58 through the vibration dampener and in alignment with the opening 40 in the offset 38 of the end wall 36 of the knob 22. This arrangement allows in situ inflation of the bladder 80 or varying the pressure therein by insertion of an inflation needle of sufficient length to extend through the passageway 58 and valve 82. The bladder 80 may also be preinflated while outside of the handle and then forced into the tubular peripheral wall 26. The frictional engagement between the bladder wall 84 and the inner surface of the peripheral wall 26 anchors the bladder in position. Once in position in handle 26, the bladder 80 supports the peripheral wall 26 to enable the wall to be constructed of thinner metal, or less metal as by grooving. The bladder 80 preferably has a length substantially equal to the length of the handle 20 and due to its resilient frictional contact with the wall 26, it will reduce or attenuate vibrations of various amplitudes and frequencies that have been transmitted to the distal end of the handle from the hitting zone 14 and the transition zone 18. Together, the bladder 80 and the soft, resilient foam-like vibration dampener 28 will effectively dampen vibrations and reduce the "sting" imparted to the hands of a person gripping the bat handle when a ball is impacted by the hitting zone.

Figure 8:
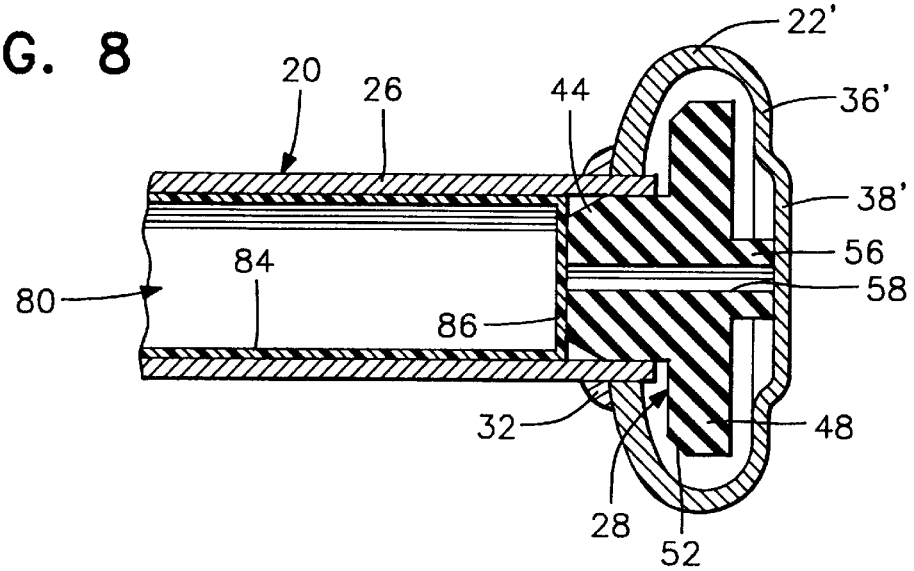
FIG. 8 is a sectional view similar to FIG. 7 but illustrating the vibration damping inflated bladder combined with the vibration dampener illustrated in FIG. 3.

FIG. 8 illustrates a structure identical to FIG. 7 except that the vibration dampener and knob are the same as illustrated in FIG. 3 in which the offset portion 38' of the end wall 36' of the knob 22' is imperforate and does not include an opening therethrough as in FIG. 7. In this configuration, the bladder must be inflated prior to mounting the knob on the handle or inflated through the distal end before insertion of the end cap 16.

Figure 9:
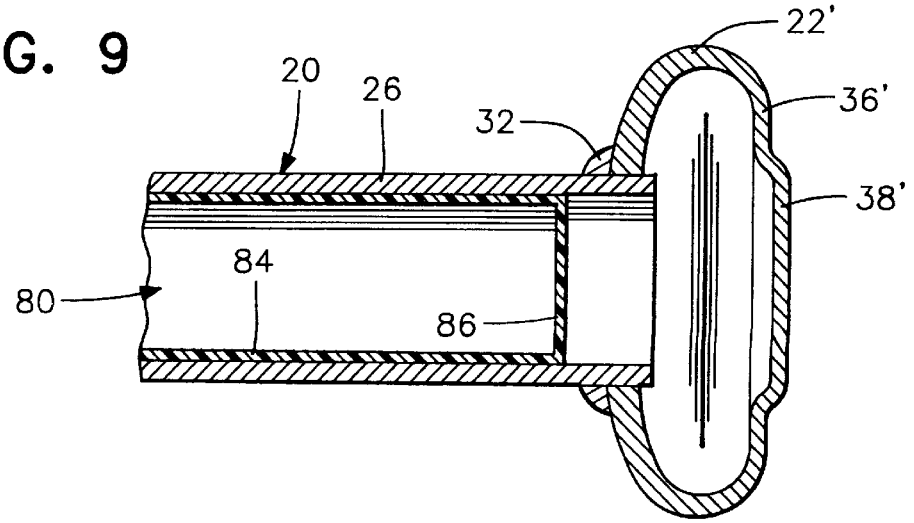
FIG. 9 is a sectional view similar to FIGS. 7 and 8 illustrating the inflated bladder alone as the vibration dampener and for support of the peripheral wall of the handle.

FIG. 9 illustrates a bladder structure similar to that illustrated in FIGS. 7 and 8. However, in this configuration, the soft, resilient, foam-like vibration dampener 28 has been omitted. Thus, the inflated bladder 80 functions as the only vibration dampening structure. The inflated bladder in FIG. 9 functions in the same way as in FIGS. 5–8 and the vibration dampening function of the bladder 80 is not augmented by the use of the resilient dampener 28.

Various gases, other than air may be used to inflate the bladder. While air and argon are preferred, gases such as nitrogen and other large molecule gases can be used and, in some instances, lightweight liquid may be used, either alone or in combination with gases to pressurize the bladder. The bladder may be pressurized in accordance with the present invention with as little as slightly above atmospheric pressure and as high as 60 psi, or even higher for special constructions. Normally, the pressurization level should range between about 15 psi to about 50 psi and, preferably, between about 20 psi and about 30 psi.

The bladder for the present invention may be constructed of any suitable material including resilient flexible materials or semirigid materials, made from neoprene, polyvinylcloride (vinyl), polyurethene esters, polyurethene ethers, olefins, polyesters, polyethylterephthlate, elastomers, polyethylene, polypropylene and other suitable plastics and the like, or even substantially rigid materials such as rigid plastic, metal or composite materials. Of the three different types of materials for construction of the bladder or bladders, a resilient flexible material is most preferred and substantially rigid material is least preferred. The peripheral wall 84 of the bladder 80, when constructed from resilient flexible material, may have a diameter that is slightly larger than the internal diameter of the peripheral wall 26 of handle 20 so that when the bladder is inserted, frictional and supporting engagement will exist between the periphery of the bladder and the inner surfaces of the peripheral wall 26 to frictionally anchor the bladder in position and support and stabilize the wall of the handle.

In circumstances where a semirigid material is used for the bladder, it may be preferable to size the diameter of the generally cylindrical peripheral wall 84 slightly less than the internal diameter of the handle wall 26 so as to permit easy insertion of the bladder into the bat handle and have the peripheral wall expand into surface-to-surface contact with the interior surface of the wall upon inflation or pressurization of the bladder. Where a rigid material is used for the bladder structure, the generally cylindrical peripheral wall 84 should have an outside diameter designed to be the same as the internal diameter of the handle wall so that as close to a surface-to-surface contact with the interior surface of the handle wall can be achieved.

It may also be possible in accordance with the present invention for the bladder component to be constructed in various forms. While a generally cylindrical tubular bladder is preferred, it will be obvious to those skilled in the art that any elongated, or other, shape can be constructed, especially using the flat sheet technology disclosed in connection with the embodiment illustrated in FIGS. 19–21 of copending application, Ser. No. 08/802,516, filed Feb. 20, 1997. Further, any number of bladders or bladder chambers can be designed to apply the requisite internal pressure to the bat handle wall. For example, plastic bubble type cushioning material that is forced into the bat handle so that the peripheral surfaces of the bubbles engage the inner surface of the handle wall and engage each other could be used. In this instance, a transverse wall structure of the type disclosed in the aforesaid copending application may be necessary in the distal end of the handle.

Pressurized bladders installed in a metal bat handle in accordance with the present invention may permit the wall thickness of the bat handle to be reduced on the order 0.005 to 0.030 inches, and perhaps even more in metal bats having thicker initial wall thicknesses. The thinning of the handle wall thickness is preferably throughout the length of the bat handle, but can be confined to the area of the bladder. Further, metal material could be removed from the interior of the bat barrel other than by thinning the entire thickness of the bat wall, such as by grooving the interior of the bat barrel in the area of the bladder. In such circumstances, it may be desirable to encase the bladder with a high strength film so as to prevent the interior grooving from damaging the bladder during bat use.

The pressurized bladder or bladders in accordance with the present invention are confined within the interior surface of the peripheral wall of the hollow bat barrel in the area of the handle thereby exerting outward pressure on the interior surface of the handle wall. This force pressurizes the peripheral wall of the handle, thus reinforcing and stiffening the peripheral wall. As previously described, the bladder reinforcement and stiffening of the bat barrel in the area of the handle enables the peripheral wall of the handle to be constructed of a thinner material thereby reducing the overall weight of the barrel and particularly the handle so that the bat speed can be increased by exerting normal hitting force on the bat handle.

While the pressurized bladder or bladders in accordance with the present invention preferably extend substantially the full longitudinal length of the bat barrel in the area of the handle, the bladder or bladders may extend less than substantially the full length of the handle and still achieve the benefits available from the present invention, at least for that portion of the handle in which the bladder or bladders provided surface-to-surface contact with the inner wall of the bat barrel and provide an outward force thereon. For example, bladders as short as about 4 inches and as long as the bat handle can be used. For most models, a bladder or bladders which extend a distance of about 8 to about 12 inches in the handle should be satisfactory. Preferably, the bladder or bladders should extend at least a major portion of the length of the handle of the particular bat model.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A metal ball bat having a tubular barrel including a hitting zone at a distal end, a handle at the proximal end, a transition zone connecting the handle and hitting zone, and a hollow unitary knob attached to the handler, said knob having a proximal end wall with an interior central area a vibration dampening device inserted in said handle and projecting into said unitary knob to dampen vibrations transmitted to the hands of a batter when the bat impacts a ball, wherein said vibration dampening device includes a body of soft, resilient, foam-like material of unitary construction having a stem inserted and anchored into a proximal end of the handle, and a peripheral flange extending beyond the periphery of the handle and into said hollow knob, said flange having its surfaces in spaced relation to the interior of the knob to enable flexing movement of the flange in all directions, wherein said flange includes an axial projection on a proximal surface thereof extending into contact with the interior central area of the proximal end wall of the knob.

2. The bat as defined in claim 1 wherein said body includes an axial passageway throughout the length thereof, said proximal end wall on the knob including an opening aligned with the passageway.

3. The bat as defined in claim 1 wherein said vibration dampening device also includes a separate pressurized bladder positioned in said handle engaging with and exerting an outward force on an interior surface of a peripheral wall of said handle.

4. The bat as defined in claim 3 wherein said bladder is cylindrical having a flexible and resilient peripheral wall in surface-to-surface contact with the interior surface of the peripheral wall of the handle.

5. The bat as defined in claim 4 wherein said bladder includes an inflation valve in a proximal end thereon.

6. A metal bat having a tubular barrel including a hitting zone at a distal end and a handle at a proximal end, said bat having a hollow portion therein, said hollow portion including a pressurized bladder positioned therein, said bladder not filling said bat hollow portion, said handle having a knob attached to said handle, said knob having an end wall, said pressurized bladder having a space between a proximal end of said pressurized bladder and said end wall of said knob.

7. The metal bat of claim 6, said pressurized bladder including an inflation valve in said proximal end thereof, said space having a vibration dampener inserted therein and projecting into said knob, said vibration dampener engaging said pressurized bladder and said end wall of said knob, said vibration dampener having a central bore therethrough aligned with said inflation valve in said pressurized bladder, said end wall of said knob having a central aperture aligned with said central bore in said vibration dampener, where said inflation valve can be accessed through said central aperture and said central bore.

8. The metal bat of claim 6, wherein said pressurized bladder is positioned in said handle engaging with and exerting an outward force on an interior surface of said handle.

9. The bat as defined in claim 6 wherein said bladder is generally cylindrical and includes a flexible and resilient peripheral wall in surface-to-surface contact with an interior surface of the handle, said bladder frictionally engaging and being anchored in the handle when inflated.

10. The bat as defined in claim 6 wherein said bladder extends a substantial portion of said handle and includes an end wall at said proximal end thereof receiving an inflation valve.

11. The bat as defined in claim 6 wherein said pressurized bladder is pressurized by a fluid selected from air, nitrogen, argon or large molecule gas.

12. The bat as defined in claim 6 wherein said pressurized bladder is pressurized to an internal pressurization between about 15 psi to about 50 psi.

13. The bat as defined in claim 12 wherein said pressurization level is between about 20 psi and about 30 psi.

14. A method of dampening the vibration in the handle of a tubular metal ball bat including a tubular barrel, said tubular barrel having a knob end, which comprises the steps of inserting a bladder having a flexible peripheral wall into said handle through an open end of the bat barrel and spacing said bladder from said knob end and pressurizing said bladder such that the flexible peripheral wall engages with the interior surface of the tubular barrel in said handle.

15. The method as defined in claim 14 and including the step of providing the bladder with a self sealing valve to enable inflation of the bladder after insertion into said handle.

16. The method as defined in claim 14 wherein said bladder is pressurized from slightly above atmospheric pressure to less than about 60 psi.

17. A metal ball bat having a tubular barrel including a hitting zone at a distal end, a handle at the proximal end, a transition zone connecting the handle and hitting zone, and a hollow unitary knob attached to the handle, said knob having a vibration dampener inserted therein prior to said knob being attached to said handle, said vibration dampening device inserted in said handle and projecting into said knob to dampen vibrations transmitted to the hands of a batter when the bat impacts a ball, wherein said vibration dampening device includes a body of soft, resilient, foam-like material of unitary construction having a stem inserted and anchored into a proximal end of the handle, and a peripheral flange extending beyond the periphery of the handle and into said hollow knob, said flange having its surfaces in spaced relation to the interior of the knob to enable flexing movement of the flange in all directions.

18. The bat as defined in claim 16, wherein said flange includes an axial projection on a proximal surface thereof extending into contact with an interior central area of a proximal end wall of the knob.

19. The bat as defined in claim 18, wherein said body includes an axial passageway throughout the length thereof, said proximal end wall on the knob including an opening aligned with the passageway.

* * * * *

UNITED STATES PATENT AND TRADEMARK OFFICE

CERTIFICATE OF CORRECTION

PATENT NO. : 6,007,439
DATED : December 28, 1999
INVENTOR(S) : Jack W. Mackay, Jr.

It is certified that error appears in the above-identified patent and that said Letters Patent is hereby corrected as shown below:

| | |
|---|---|
| Col. 1, Line 28 | Delete "pading" and insert --pending-- therefor. |
| Col. 1, Line 32 | Delete "pading" and insert --pending-- therefor. |
| Col. 9, Line 22, Claim 1 | Delete "handler" and insert --handle-- therefor. |
| Col. 10, Line 58, Claim 18 | Delete "16" and insert --17-- therefor. |

Signed and Sealed this

Fourteenth Day of November, 2000

*Attest:*

Q. TODD DICKINSON

*Attesting Officer*

*Director of Patents and Trademarks*